US006547585B2

(12) United States Patent
Bradley et al.

(10) Patent No.: US 6,547,585 B2
(45) Date of Patent: Apr. 15, 2003

(54) CABLE HOLDER FOR SUPPORTING A PLURALITY OF CABLE CONNECTORS

(75) Inventors: Eddie R. Bradley, Richardson, TX (US); Melvin G. Peel, Plano, TX (US)

(73) Assignee: Alcatel, societe anonyme, Paris (FR)

( * ) Notice: Subject to any disclaimer, the term of this patent is extended or adjusted under 35 U.S.C. 154(b) by 0 days.

(21) Appl. No.: 09/882,918

(22) Filed: Jun. 15, 2001

(65) Prior Publication Data

US 2002/0193016 A1 Dec. 19, 2002

(51) Int. Cl.[7] ..... H01R 13/627
(52) U.S. Cl. ..... 439/353; 439/701
(58) Field of Search ..... 439/790, 353, 439/701, 344, 540.1, 352

(56) References Cited

U.S. PATENT DOCUMENTS 995,627 A * 6/1911 Murray ..... 324/74
3,997,234 A * 12/1976 Worman ..... 439/456
5,579,425 A * 11/1996 Lampert et al. ..... 385/59
6,109,978 A * 8/2000 Stellman et al. ..... 439/701
6,123,564 A * 9/2000 Bellmore, III ..... 439/344
6,158,111 A * 12/2000 Doye et al. ..... 29/739
6,250,817 B1 * 6/2001 Lampert et al. ..... 385/56
6,343,950 B1 * 2/2002 Eginton et al. ..... 439/540.1

* cited by examiner

*Primary Examiner*—Lynn Field
*Assistant Examiner*—Hae Moon Hyeon
(74) *Attorney, Agent, or Firm*—William J. Tucker; V. Lawrence Sewell; Craig A. Hoersten

(57) ABSTRACT

A cable holder is described that includes a connector holder that is configured to receive several cable connectors each of which are attached to a cable. The cable holder also includes one or more latch bars that are connected to the connector holder and configured to enable a user to interact with each latch bar so as to depress a tab on each of the cable connectors which enables the user to insert at the same time all of the cable connectors into a connector. Thereafter, the user can interact with each latch bar so as to depress a tab on each of the cable connectors which enables the user to remove at the same time all of the cable connectors from the connector.

16 Claims, 3 Drawing Sheets

CABLE HOLDER FOR SUPPORTING A PLURALITY OF CABLE CONNECTORS

BACKGROUND OF THE INVENTION

1. Field of the Invention

The present invention relates in general to a cable holder that is capable of supporting several cable connectors such as Ethernet connectors and telephone connectors and their associated cables.

2. Description of Related Art

It is well known how difficult it is for a technician to connect a large number of cable connectors and their associated cables into a single connector. The main problem facing the technician involves the tedious and time-consuming task of individually terminating a relatively large number of cable connectors into a relatively small connector. For example, technicians today must individually terminate sixteen RJ45 cable connectors and their associated Ethernet cables into a RJ45 connector that has two rows of eight closely-spaced jacks. Due to the small size of the connector, the technician has to be very patients when terminating the cable connectors and also has to be careful not to plug the cable connectors in the wrong order into the connector.

Another problem facing the technician today involves the tedious task of remembering where the cable connectors that have been removed from the connector need to be re-inserted into the connector since the removed cable connectors and their associated cables can be easily mixed up and tangled with one another. To date, there does not appear to be a simple and economically feasible solution to the aforementioned problems where a technician must individually insert and individually remove a large number of cable connectors into and from a small connector. As such, there has been a persistent need for a cable holder that can effectively hold a large number of cable connectors and cables so that all of the cable connectors can be inserted into and/or removed from a connector at the same time. This need and other needs are satisfied by the cable holder and methods of the present invention.

BRIEF DESCRIPTION OF THE INVENTION

The present invention includes a cable holder, a method for assembling the cable holder and a method for using the cable holder. Basically, the cable holder includes a connector holder that is configured to receive several cable connectors each of which are attached to a cable. The cable holder also includes one or more latch bars that are connected to the connector holder and configured to enable a user to interact with each latch bar so as to depress a tab on each of the cable connectors which enables the user to insert at the same time all of the cable connectors into a connector. Thereafter, the user can interact with each latch bar so as to depress a tab on each of the cable connectors which enables the user to remove at the same time all of the cable connectors from the connector. In addition, the cable holder can include a cover that is configured to maintain a position of the cable connectors within the connector and is also configured to receive the cables that are attached to the cable connectors.

BRIEF DESCRIPTION OF THE DRAWINGS

A more complete understanding of the present invention may be had by reference to the following detailed description when taken in conjunction with the accompanying drawings wherein.

DETAILED DESCRIPTION OF THE DRAWINGS

Referring to FIGS. 1–6, there is disclosed a preferred embodiment of a cable holder 100 and methods 500 and 600 in accordance with the present invention. Although the cable holder 100 is described as supporting sixteen RJ45 Ethernet cable connectors and cables, it should be understood that the cable holder 100 can be used to support any number of cable connectors and a wide variety of cable connectors including, for example, telephone connectors, ISDN/LAN connectors and many other types of Ethernet connectors. Accordingly, the cable holder 100, the method 500 for assembling the cable holder 100 and the method 600 for using the cable holder 100 should not be construed in a limited manner.

Figure 1:
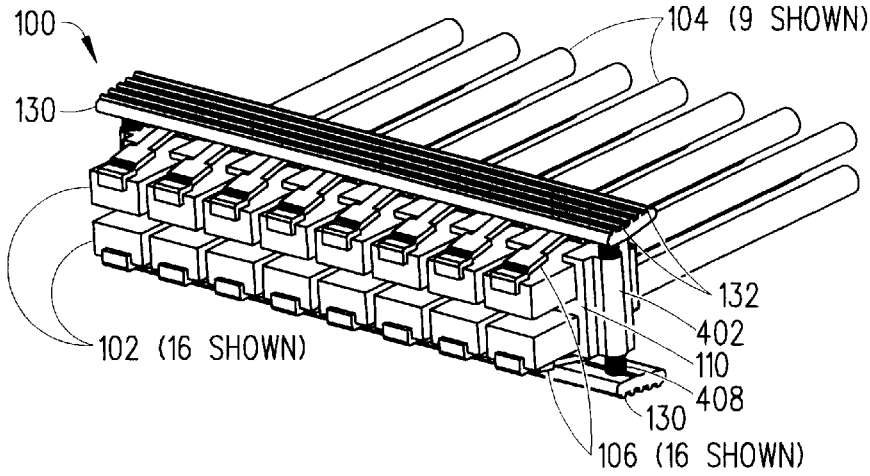
FIG. 1 is a perspective view of an assembled cable holder that is supporting sixteen cable connectors and sixteen cables in accordance with the present invention.
Figure 2:
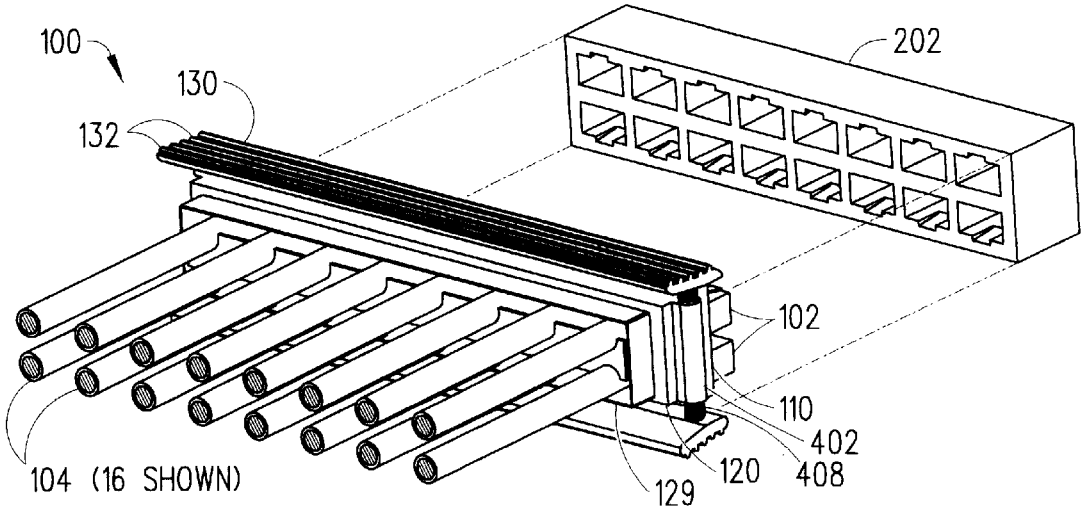
FIG. 2 is a perspective view of the assembled cable holder and a connector that can receive the cable connectors held by the assembled cable holder of FIG. 1.
Figure 3:
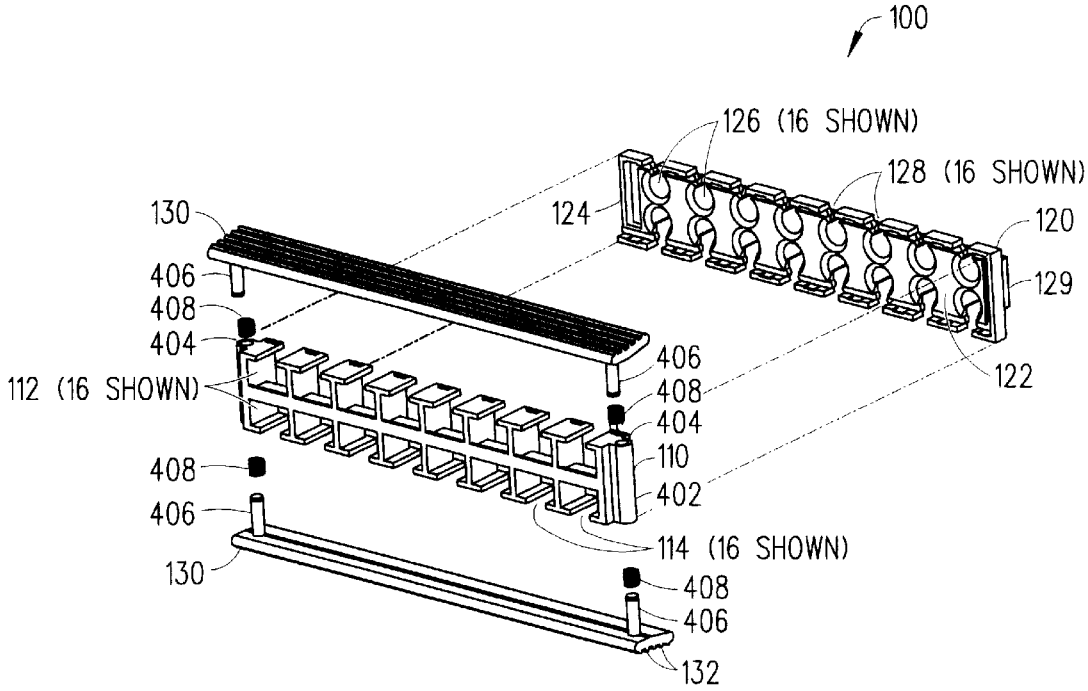
FIG. 3 is an exploded perspective view of a disassembled cable holder without the sixteen cable connectors and the sixteen cables shown in FIG. 1.

Referring to FIGS. 1–3, there are respectively shown perspective views of an assembled cable holder 100 (FIGS. 1–2) and an exploded perspective view of a disassembled cable holder 100 (FIG. 3). The cable holder 100 includes a connector holder 110, a cover 120 and one or more latch bars 130 (two shown). The connector holder 110 is configured to receive and hold one or more cable connectors 102 each of which is connected to a cable 104. As illustrated, the connector holder 110 is configured to receive and hold two rows of eight cable connectors 102 for a total of sixteen cable connectors 102 and their associated cables 104. However as described above, the connector holder 110 can be sized to support any number of cable connectors 102 and a wide variety of cable connectors 102 including, for example, telephone connectors, ISDN/LAN connectors and different types of Ethernet connectors.

The connector holder 110 includes a series of slots 112 each of which is sized to receive and hold one of the cable connectors 102. As illustrated in FIG. 3, each slot 112 (sixteen shown) has a rectangular shape that corresponds to the shape of the cable connector 102. In addition, each slot 112 includes an opening 114 sized to enable a tab 106 of the cable connector 102 to extend out of the connector holder 110. Again, it should be noted that the connector holder 110 can have any number of slots 112 including a single row of eight slots 112 each of which are configured to receive a cable connector 102.

The cable holder 100 can also include a cover 120 that is configured to maintain the positions of the cable connectors 102 within the connector holder 110 when the cover 120 is attached to the connector holder 110. The cover 120 can be attached to the connector holder 110 via a snap-fit mechanism or some other connection mechanism. Typically, the connector holder 110 would already be holding the cable connectors 102 when the cover 120 is attached to the connector holder 110.

In particular, the cover 120 includes a cavity 122 that is sized to fit over at least a back portion of all of the cable connectors 102 extending from the connector holder 110. The cover 120 also includes an edge 124 surrounding the cavity 122 that is sized to interface with and attach to the perimeter of connector holder 110. Moreover, the cover 120 can include a series of slots 126 that are configured to receive the cables 104 attached to the cable connectors 102. As illustrated in FIG. 3, the cover 120 includes sixteen slots 126 positioned and configured to receive and hold two rows of eight cables 104 for a total of sixteen cables 104. Each slot 126 includes an opening 128 through which a cable 104 can pass through so as to be held within that slot 126. Like the connector holder 110, the cover 120 can be configured to receive and hold any number and type of cables 104. In addition, the cover 120 can include a back portion 129 that helps support the cover 120 by providing some extra rigidity to the cover 120.

The cable holder 100 also includes one or more latch bars 130 (two shown) coupled to the connector holder 110 in a position that allows a technician to interact with and push down on the latch bars 130 which depresses each of the tabs 106 on the cable connectors 102 and enables the technician to insert (or re-insert) all of the cable connectors 102 at the same time into a connector 202 (see FIG. 2). This is a marked improvement over the prior art wherein a technician without the cable holder 100 had to individually insert each cable connector 102 into the connector 202.

Alternatively, the user can also interact with and push down on the latch bars 130 which depresses each of the tabs 106 on the cable connectors 102 and enables the technician to remove at the same time all of the cable connectors 102 from the connector 202. This is a marked improvement over the prior art wherein a technician without the cable holder 100 had to individually remove each cable connector 102 from the connector 202. In addition, since the cable holder 100 maintains the proper position of the cable connectors 102 and cables 104 with respect to their position in the connector 202, the technician no longer has to remember where the removed cable connectors 102 need to be re-inserted into the connector 202. To help the technician maintain the proper orientation of the cable holder 100 with respect to the connector 202, the connector holder 110 and the connector 202 may have a red dot or some other indicia that the technician can line up with one another when inserting the cable connectors 102 into the connector 202.

Instead of removing all of the cable connectors 102 at the same time from the connector 202, the technician can interact with and depress one or more of the tabs 106 on the cable connectors 102 without depressing the latch bars 130 which enables the technician to remove only those cable connectors 102 from the connector 202. In this way, the technician can remove one or more cable connectors 102 from the cable holder 100 and the connector 202 while the other cable connectors 102 remain held by the cable holder 100 and connected to the connector 202.

As shown in FIGS. 1–3, the cable holder 100 includes a first latch bar 130 that extends along a top side of the connector holder 110 and a second latch bar 130 that extends along a bottom side of the connector holder 110. The use of two latch bars 130 allows the technician to insert/remove two rows of cable connectors 102 at the same time into/from the connector 202. The grooves 132 formed on the top surface of the latch bars 130 make it more rigid and also make it easier for a technician to interact with the latch bars 130. How the latch bars 130 can be connected to the connector holder 110 is described below with respect to FIG. 4. And, how a technician can assemble the cable holder 100 and use the assembled cable holder 100 is described below with respect to the methods 500 and 600 of FIGS. 5 and 6.

Figure 4:
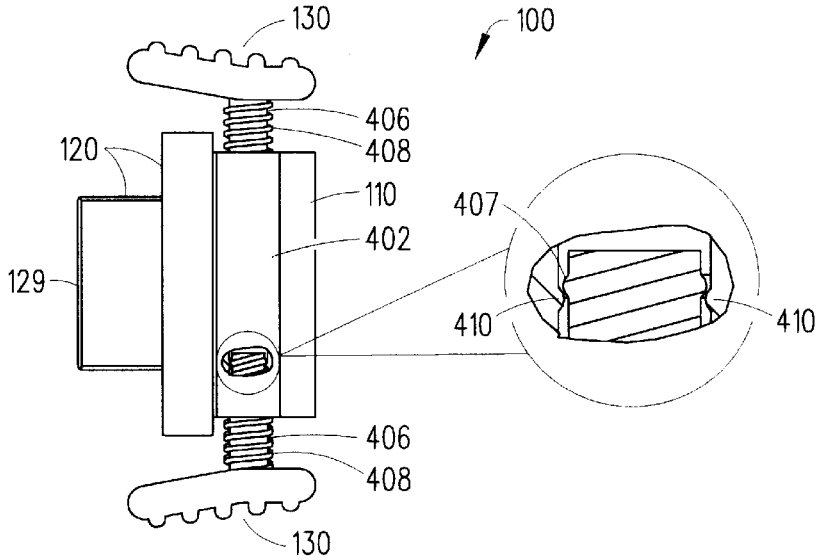
FIG. 4 is a side view of the assembled cable holder without the sixteen cable connectors and the sixteen cables shown in FIG. 1.

Referring to FIG. 4, there is illustrated a side view of the assembled cable holder 100. Each side of connector holder 110 includes a cylinder 402 that has a passageway 404 that can receive one or more extensions 406 (two shown) of the latch bars 130 (two shown). In particular, each extension 406 may include an annular ring 408 that cam bypass a similar annular ring 410 formed within the passageway 404 of the cylinder 402. This helps prevent the removal of the latch bars 130 from the connector holder 110.

A spring 408 (two shown) can encompass the portion of the extension 406 of the latch bar 130 that is not within the cylinder 402. The spring 408 is biased so that after the technician pushes down on the latch bars 130 to insert or remove the cable connectors 102 into or from the connector 202 (see FIG. 2) the latch bars 130 return to their normal position which is above the tabs 106 on the cable connectors 102. The side view also shows the cover 120 attached to the connector holder 110.

Figure 5:
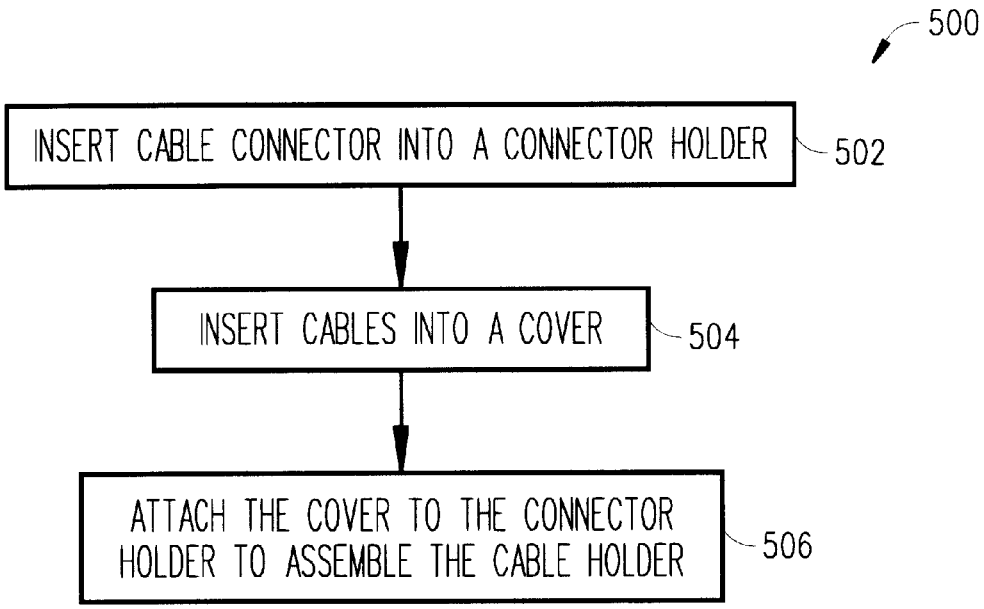
FIG. 5 is a flowchart illustrating the basic steps of a preferred method for assembling the cable holder in accordance with the present invention.

Referring to FIG. 5, there is flowchart illustrating the basic steps of a preferred method 500 for assembling the cable holder 100. Beginning at step 502, the cable connectors 102 are inserted into the connector holder 110. In particular, the cable connectors 102 are inserted into the slots 112 of the connector holder 110 such that the tabs 106 on the cable connectors 102 extend through the slot openings 114.

At step 504, the cables 104 associated with the cable connectors 102 are then inserted into the cover 120. In particular, the cables 104 are passed through the slot opening 128 in the cover 120 and held in the slots 126 of the cover 120. It should be understood that the cover 120 does not need to be connected to the connector holder 110 when the cables 104 are inserted into the slots 126. In fact, the cables 104 can be inserted into the slots 126 of the cover 120 before the. cable connectors 102 are inserted into the slots 112 of the connector holder 110 and the cover 120 is attached to the connector holder.

At step 506, the cover 120 is attached to the connector holder 110 in a manner that helps to hold the cable connectors 102 within the connector holder 110. Again, the cover 120 can be attached to the connector holder 110 using a snap fit mechanism or some other mechanism. It should be understood that a technician in the field can assemble the cable holder 100 or that a manufacturer can assemble the cable holder 100 for the technician. In either case, the assembled cable holder 100 can be used by the technician in the field as described below with respect to FIG. 6.

Figure 6:
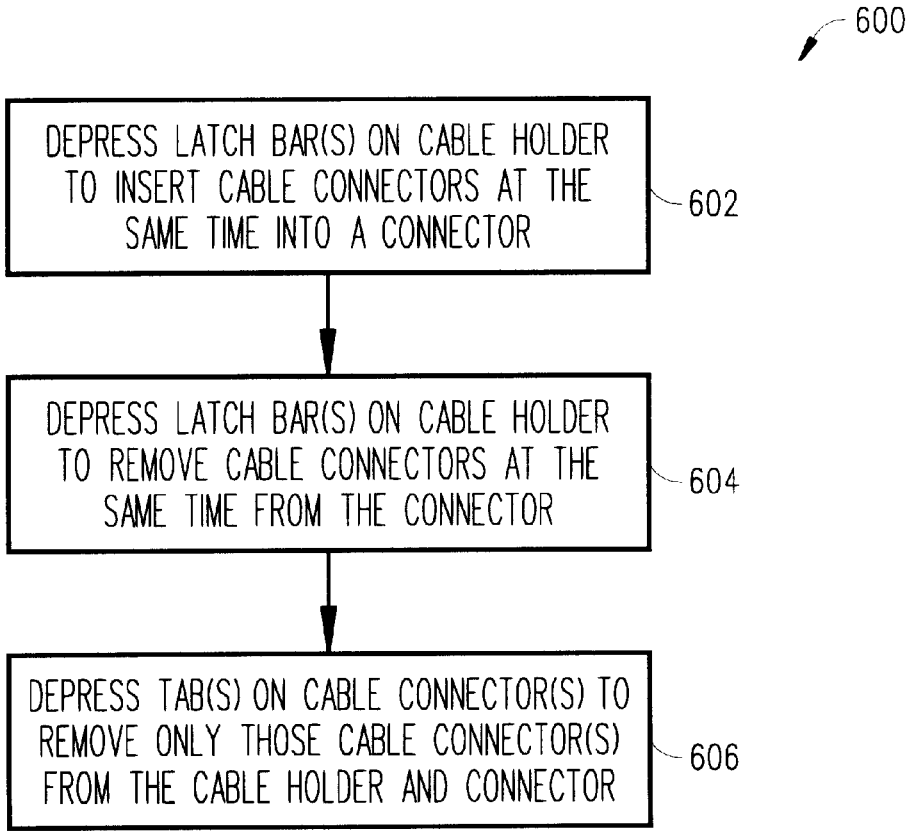
FIG. 6 is a flowchart illustrating the basic steps of a preferred method for using the assembled cable holder in accordance with the present invention.

Referring to FIG. 6, there is a flowchart illustrating the basic steps of a preferred method 600 for using the assembled cable holder 100. Beginning at step 602, the cable connectors 102 held by the cable holder 100 are inserted at the same time into the connector 202 (see FIG. 2). To accomplish this, the technician can press down on the latch bars 130 which depresses each of the tabs 106 on the cable connectors 102 and facilitates the insertion of the cable connectors 102 into the connector 202. Again, this is a marked improvement over the prior art where a technician had the tedious and time consuming task of individually inserting each cable connector 102 into the connector 202.

At step 604, the cable connectors 102 held by the cable holder 100 and also inserted into the connector 202 can be removed at the same time from the connector. To accomplish this, the technician can press down on the latch bars 130 which depresses each of the tabs 106 on the cable connectors 102 and enables the removal of all of the cable connectors 102 from the connector 202. Again, this is a marked improvement over the prior art where a technician had to individually remove each cable connector 102 from the connector 202 and also had to remember where each removed cable connector 102 had to be re-inserted. into the connectors 202. It would be difficult for the technician without the cable holder 100 to remember where each cable connector needs to be re-inserted into the connector since the removed cable connectors and their associated cables can be easily mixed up and tangled with one another.

At step 608, instead of removing all of the cable connectors 102 at the same time from the connector 202, the technician can interact with and depress one or more of the tabs 106 on the cable connectors 102 which enables the technician to remove only those cable connectors 102 from the cable holder 100 and the connector 202. In this way, the technician can remove one or more cable connectors 102 from the connector 202 and the cable holder 100 while the other cable connectors 102 remain connected to the connector 202 and held by the cable holder 100.

Again, although the cable holder 100 is described as supporting sixteen cable connectors 102 and cables 104, it should be understood that the cable holder 100 can be used to support any number of cable connectors and a wide variety of cable connectors including, for example, telephone connectors, ISDN/LAN connectors and many other types of Ethernet connectors.

Although one embodiment of the present invention has been illustrated in the accompanying Drawings and described in the foregoing Detailed Description, it should be understood that the invention is not limited to the embodiment disclosed, but is capable of numerous rearrangements, modifications and substitutions without departing from the spirit of the invention as set forth and defined by the following claims.

What is claimed is:

1. A cable holder comprising:

a connector holder configured to receive a plurality of cable connectors;

at least one bar, attached to said connector holder, configured and positioned to enable a user to interact with said at least one bar so as to depress a tab on each of the cable connectors which enables the user to remove the plurality of cable connectors from a connector; and a cover configured to maintain a position of the plurality of cable connectors within said connector holder and also configured to receive a plurality of cables attached to the plurality of cable connectors.

2. The cable holder of claim 1, wherein said cover further includes a plurality of slots configured to receive and hold the plurality of cables.

3. The cable holder of claim 1, wherein said connector holder further includes a plurality of slots configured to receive and hold the plurality of cable connectors.

4. The cable holder of claim 1, further comprising at least one spring that interacts with one of the bars and said connector holder.

5. The cable holder of claim 1, wherein said cable connectors are local area network connectors.

6. The cable holder of claim 1, wherein said cable connectors are telephone connectors.

7. A cable holder comprising:

a connector holder capable of receiving a plurality of cable connectors;

a cover capable of holding the plurality of cable connectors within said connector holder and also capable of receiving a plurality of cables attached to the plurality of cable connectors; and a latch bar, attached to said connector holder, capable of engaging a tab on each of the cable connectors so as to enable removal of the plurality of cable connectors from a connector.

8. The cable holder of claim 7, wherein said connector holder further includes a plurality of slots each of which is capable of receiving and holding one of the plurality of cable connectors.

9. The cable holder of claim 7, wherein said cover further includes a plurality of slots each of which is capable of receiving and holding one of the plurality of cables.

10. The cable holder of claim 7, wherein said latch bar is a spring-loaded latch bar.

11. The cable holder of claim 7, wherein said latch bar further includes a surface having a plurality of grooves.

12. The cable holder of claim 7, wherein said cable connectors are Ethernet connectors.

13. A method for using a cable holder, said method comprising the step of:

inserting a plurality of cable connectors into a cable holder, said cable holder including:

a connector holder configured to receive the plurality of cable connectors; and at least one latch bar, attached to said connector holder, configured and positioned to enable a user to interact with said at least one latch bar so as to depress a tab on each of the cable connectors which enables the user to insert the plurality of cable connectors into the connector;

inserting the plurality of cable connectors into the connector holder of the cable holder;

inserting a plurality of cables attached to the plurality of cable connectors into a cover of the cable holder; and attaching the cover to the connector holder so as to hold the plurality of cable connectors within the connector holder.

14. The method of claim 13, further comprising the step of interacting with the at least one latch bar so as to depress a tab on each of the cable connectors which enables a user to remove the plurality of cable connectors from the connector.

15. The method of claim 13, further comprising the step of depressing the tab of one of the cable connectors to remove that cable connector from the connector and the cable holder while the remaining cable connectors are held by the cable holder and inserted into the connector.

16. The method of claim 13, wherein the cable connectors are RJ45 connectors.

* * * * *